United States Patent [19]

Ellington et al.

[11] 4,112,860

[45] Sep. 12, 1978

[54] METHOD OF FABRICATING SHIRT CUFFS

[75] Inventors: Gordon H. Ellington; William O. Mitchell; Don E. Estapa, all of Vidalia, Ga.

[73] Assignee: Oxford Industries, Inc., Atlanta, Ga.

[21] Appl. No.: 548,968

[22] Filed: Feb. 11, 1975

Related U.S. Application Data

[63] Continuation-in-part of Ser. No. 521,297, Nov. 6, 1974, Pat. No. 3,901,173.

[51] Int. Cl.[2] ..... D05B 1/00

[52] U.S. Cl. ..... 112/262; 83/365; 112/121.15; 112/121.29; 112/130; 112/147; 214/1 PE

[58] Field of Search ..... 112/262, 130, 129, 122, 112/2, 121.11, 121.12, 121.15, 121.29, 147; 83/365; 214/1 PE

[56] References Cited

U.S. PATENT DOCUMENTS

| | | | |
|---|---|---|---|
| 2,171,362 | 8/1939 | Gulliksen | 214/1 PE |
| 2,685,664 | 8/1954 | Visconti | 112/130 |
| 3,329,113 | 7/1967 | Lewis et al. | 112/130 |
| 3,401,655 | 9/1968 | Johnson et al. | 112/130 X |
| 3,670,679 | 6/1972 | Campbell | 112/130 X |
| 3,772,948 | 11/1973 | Benton | 83/365 X |
| 3,780,682 | 12/1973 | Frost | 112/262 |
| 3,884,166 | 5/1974 | Rinehimer et al. | 112/130 X |

*Primary Examiner*—H. Hampton Hunter
*Attorney, Agent, or Firm*—Jones, Thomas & Askew

[57] ABSTRACT

A series of shirt cuff pattern parts are placed in spaced apart relationship on a web of lining material and a conveyor belt system engages and holds the layers of material together as they are moved through a folder and a sewing machine. The movement terminates automatically if the space between the pattern part last received by the system and the pattern part next to be fed to the system is too great or too small. The connected together series of partially completed shirt cuffs is continuously accumulated from the sewing machine on a reel, and the reel is subsequently moved to another work station where the connected series of partially completed shirt cuffs is fed to a cutter on a demand basis. The web of lining material is cut adjacent the trailing edge of the leading pattern part, and when an operator removes the separated partially completed shirt cuff from the connected series for further processing, the feeding and cutting steps are repeated.

14 Claims, 3 Drawing Figures

METHOD OF FABRICATING SHIRT CUFFS

CROSS REFERENCE TO RELATED APPLICATIONS

This application is a continuation-in-part of application Ser. No. 521,297, filed Nov. 6, 1974, now U.S. Pat. No. 3,901,173, issued Aug. 26, 1975.

BACKGROUND OF THE INVENTION

The process of making shirt sleeve cuffs in the past has required a plurality of difficult alignment and sewing steps and has required skilled machine operators because of the multiple number of plies of outer cuff pattern parts and inner lining pattern parts required to form the cuff, and because the pattern parts are small and are easily misplaced. For example, a typical cuff making process required both the outer cuff panels and inner lining panel to be cut in the cutting room by die cutting or clicking, and the outer panels and liner panel were tagged in the cutting room and then transferred to the sewing stations in the sewing room. At the first sewing station an operator aligned the inner liner panel with a first cuff panel, folded the overlying edge of the cuff panel over an edge of the liner panel, and sewed through the fold to form a hem or Brighton roll in the cuff panel about the edge of the liner panel. The plurality of partially completed cuffs formed in this manner were connected in series by a chain stitch extending between adjacent ones of the partially completed cuffs and the partially completed cuffs were accumulated at the first sewing station.

After a bunch of outer cuff panels has been passed through the first sewing station to form a bunch of partially completed shirt cuffs, the bunch was transferred to a second sewing station where the second outer cuff panel was aligned in overlying relationship with the first cuff panel and folded about the hem of the first cuff panel, and the operator then stitched in a U-shaped path about an end of the fold and around the unstitched edges of the inner liner and cuff panels and over the other end of the fold to complete the cuff. The cuffs were again connected together by chain stitching as they left the sewing station, and when the batch of cuffs had passed through the second sewing station they were transferred to a subsequent work station where the cuffs were separated, everted, pressed, and stacked.

The old procedure required not only the cuff panels but the liner to be cut to shape in the cutting room so that a substantial amount of liner material as well as cuff panel material was wasted. Also, the slow processes of aligning the edges of cuff panels and liner panels were required at both the first and second sewing stations, and the sequence of the outer panels had to be maintained at both the first and second sewing stations so that one or both oeprators would not incorrectly match cuff panels in a cuff structure from different bunches of material or from different layers in a bunch and form cuff structures having mismatched colors.

SUMMARY OF THE INVENTION

Briefly described, the present invention comprises a process of forming shirt cuffs or the like wherein a continuous web or cuff lining material moves along a path at a first work station through a sewing machine, and precut cuff pattern parts from a bunch of pattern parts are placed in spaced apart relationship on the web with each cuff pattern part having an edge portion overlying an edge of the lining material. Conveyor belts move into contact with the lining material and pattern parts and hold them together as the belts move the pattern parts and web through a folder and the sewing machine. A photoelectric cell detects the space between the last pattern part placed on the web and moving into the conveyor belts and the next pattern part next to be fed to the conveyor belts, and if the space between the pattern parts is too great or to small, the operation of the system is terminated. The overlying portion of each pattern part is folded about and under the edge of the web of lining material, and the folded portion of each pattern part and the web of the lining material are sewn together by the sewing machine. As the connected together series of partially formed shirt cuffs leave the sewing machine, they are continuously accumulated on a take up reel until the entire bunch of pattern parts has been sewn to the web of lining material, whereupon the web of lining material is cut and the reel is transferred to a second work station.

The connected series of partially completed cuff pattern parts is fed from its accumulation on the reel at the second work station through a detector and a cutter on a demand basis. The detector determines when the trailing edge of a cuff panel pattern part moves across a predetermined point toward the cutter, and in response to this detection, the movement of the pattern part is interrupted and a disc cutter rolls across the web of lining material ajacent the trailing edge of the pattern part to separate the partially completed cuff from the series. The now separated partially completed cuff remains at the cutter until it is removed by a worker for further processing, and the movement of the connected series of partially completed cuffs through the cutter does not resume until the previously separated cuff has been removed by the worker. The worker places a second cuff panel from a bunch of pattern parts on the partially completed cuff and feeds the assembled cuff to a sewing and trimming machine which automatically trims the pattern parts and lining material to the proper shape and sews in a U-shaped path about the edges of the plies of material to complete the cuff. The completed cuff is subsequently everted, pressed and attached to the sleeve of a shirt.

Thus, it is an object of the present invention to provide a continuous process for fabricating shirt cuffs or the like that requires a relatively unskilled operator and which functions rapidly, accurately and economically to properly form partially completed shirt cuffs.

Other objects, features and advantages of the present invention will become apparent upon reading the following specification, when taken in conjunction with the accompanying drawing.

DETAILED DESCRIPTION

Figure 1:
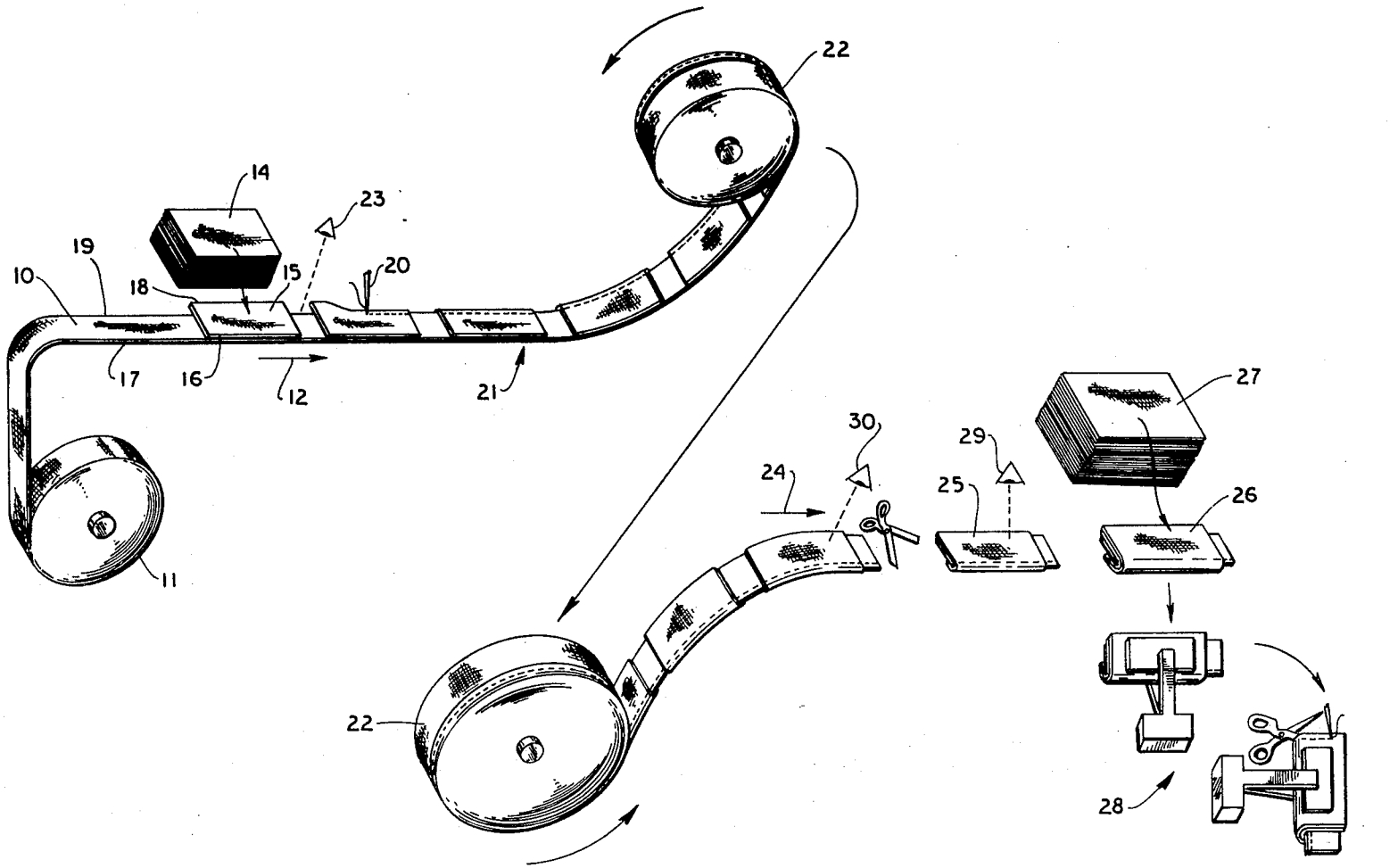
FIG. 1 is a schematic illustration of the process of forming shirt cuffs.

Referring now in more detail to the drawing, in which like numerals indicate like parts throughout the views, FIG. 1 is a schematic illustration of the process of forming shirt cuffs wherein a web 10 of lining material is taken from a supply such as reel 11 and moved through a path in the direction as indicated by arrow 12 at a first work station. A bunch 14 of shirt cuff pattern parts or panels is placed adjacent the path traveled by web 10, and a worker takes the top ply or pattern part 15 from the bunch 14 and places it on the moving web 10. Each pattern part 15 is placed in spaced apart relationship with respect to each preceding pattern part so that the web of lining material is exposed between adjacent ones of the pattern parts. Each pattern part 15 is wider than the web 10 and one edge 16 of each pattern part is placed in alignment with edge 17 of the web 10, and the other edge 18 of the pattern part overlies the edge 19 of the web. As the web 10 and pattern parts 15 move along the path toward a sewing machine 20, the overlying edge of the pattern part is folded down and about the edge 19 of the web to form a hem about the edge 19 of the web, and the sewing machine 20 sews through the hem. It is desirable to have a space between adjacent ones of the pattern parts for purposes which will become apparent hereinafter; however, it is also desirable to have only a small space between adjacent ones of the pattern parts so that the web material is not wasted. Photoelectric cell 23 is positioned in the vicinity of the path of the overlying edges of the pattern parts to detect the spacing between the adjacent pattern parts as they move toward the folding station, and the photo cell controls the movement of the web and pattern parts as will be explained hereinafter. The sewing machine thus forms a connected series 21 of partially completed shirt cuffs and the series of partially completed shirt cuffs are accumulated at 22 on a reel.

The accumulation of the connected series of partially completed shirt cuffs is transferred from the first work station to a second work station, and the series of partially completed cuffs are paid out from the accumulation along a second path 24 on a demand basis, where the leading partially completed cuff 25 is cut from the series. A worker retrieves the separated partially completed shirt cuff 25 and matches another cuff pattern part or panel 26 taken from a bunch 27 with the assembly, and the assembled shirt cuff is placed in an automatic trimming and sewing machine 28 which grasps the assembly and sews and trims the shirt cuff. The automatic trimming and sewing machine 28 is not a part of this invention. A first photoelectric cell 29 detects the absence of the partially completed shirt cuff 25 which was retrieved by the worker and causes the cutting system to begin its feeding and cutting cycle. The second photoelectric cell 30 detects the proper location along the length of the connected series of partially completed shirt cuffs where the next cut should be made and actuates the cutter and terminates the cycle.

Figure 2A:
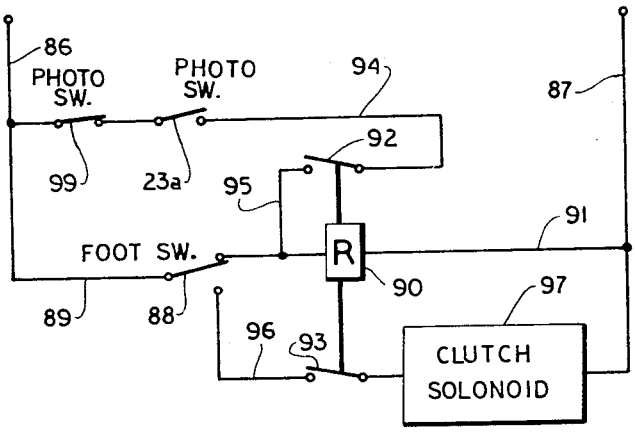
FIG. 2A is an electrical schematic of some of the control circuitry used in the operation of the apparatus illustrated in FIG. 2.
Figure 2:
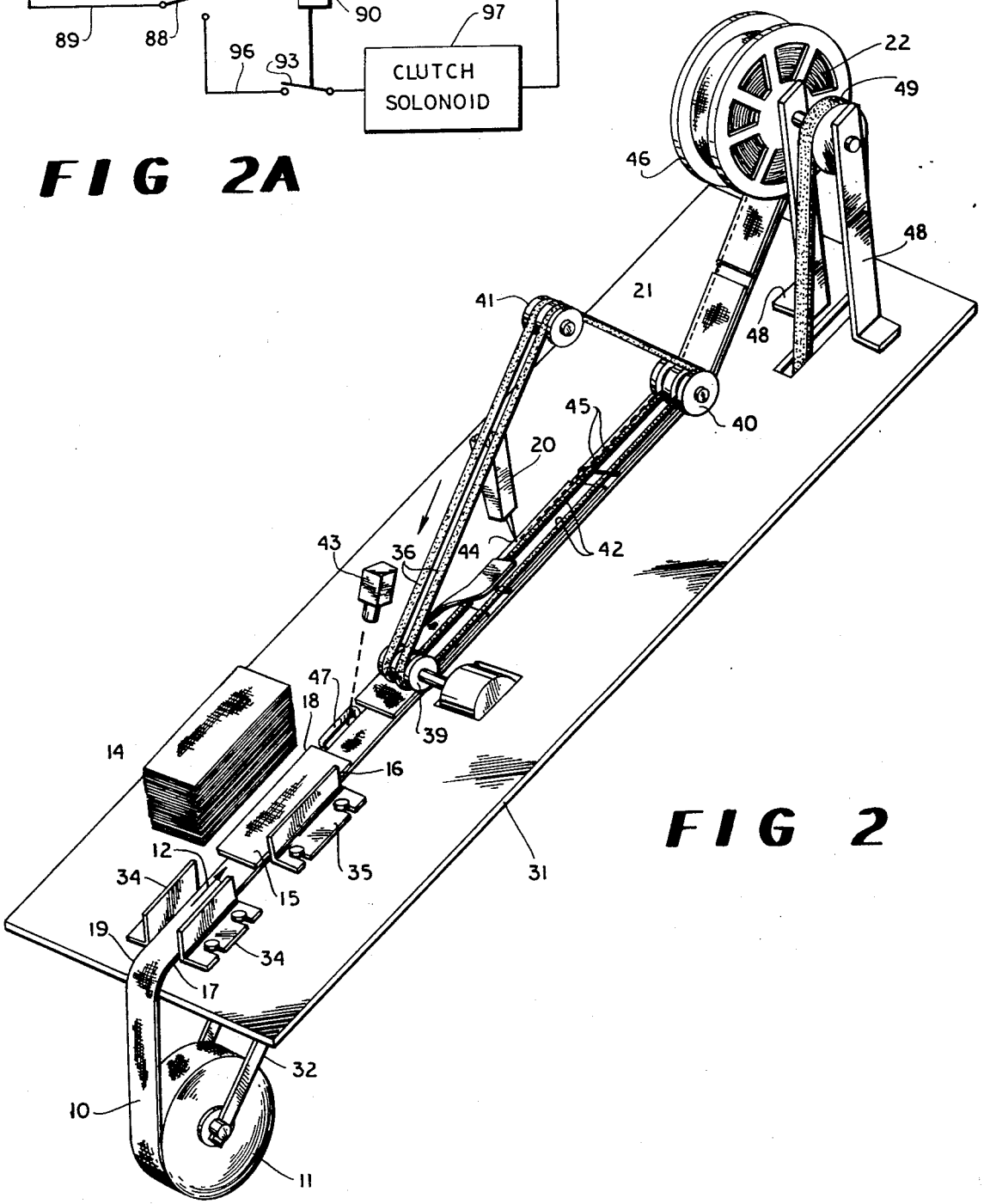
FIG. 2 is a schematic perspective illustration of the folding and sewing apparatus used at the first work station.

As is illustrated in FIG. 2, the first work station includes a work table 31 having a supply reel support 32 attached thereto at one end, and a guide means such as a pair of web guide plates 34 adjustably attached to the work table to guide the web 10 from its supply 11 through a predetermined path across the work table as indicated by arrow 12. A second guide means or abutment plate 35 is mounted on work table 31. Abutment plate 35 as well as guide plates 34 each include a horizontal portion adjustably attached to the upper surface of the work table and a vertical portion. Plates 34 are spaced apart a distance sufficient to accommodate the width of web 10, and abutment plate 35 is located so that its vertical portion is in alignment with the edge 17 of web 10. The cuff pattern parts 15 are taken from bunch 14 by a worker and placed on web 10 with one edge 16 in abutment with the abutment plate 35, which aligns the edge 16 of each pattern part 15 with the edge 17 of the web 10, and causes the opposite edge 18 of the cuff pattern part 15 to overlie the opposite edge 19 of the web 10.

A pair of endless conveyor belts 38 move about sewing machine 20, as guided by rollers 39, 40 and 41. The rollers 39 and 40 are positioned above the path to be traveled by web 10, and roller 41 is positioned above the sewing machine 20 so that the return flights of the conveyor belts extend over the sewing machine. The lower driving flights 42 of the conveyor belts 38 engage the upper surfaces of the cuff pattern parts 15 and the web 10 and urge the layers of material through folder 44 and sewing machine 20. In actual practice, another pair of conveyor belts (not shown) aids in moving the web 10 and pattern parts 15 along their path, and these belts are moved from beneath the work table up onto the surface of the work table and into a sandwich relationship with respect to the upper conveyor belts 38 and web 10 and pattern parts 15 and travel at the same speed as conveyor belts 38 from the position of first roller 39 to the position of second roller 40, and the lower conveyor belts then move in a downward return flight below the surface of work table 31.

The shirt cuff pattern parts 15 and web 10 move through folder 44 and sewing machine 20 with the belts 38 and lower belts (not shown) positively controlling the speed and direction of movement of the plies of material, and a continuous stitch 45 is formed by sewing machine 20 through the layers of material at the fold, so that the folded-over portion of each shirt cuff pattern part is sewn closed about an edge of the web 10, and a connected series 21 of shirt cuffs is formed. The connected series of shirt cuffs 21 are moved by the conveyor belt beyond sewing machine 20 until the conveyor belts move upwardly away from the connected series of shirt cuffs, whereupon take-up reel 46 accumulates the series. Take-up reel 46 is supported by reel supports 48, and the reel 46 is driven through a belt drive system 49 which includes a conventional slip clutch (not shown) from the same power source used to drive the conveyor belts 38 and sewing machine 20. The accumulation 22 of the series of partially completed shirt cuff assemblies on reel 46 is subsequently transferred to the second work station illustrated in FIG. 3, usually after the entire bunch 14 of cuff pattern parts has been connected in the series on the web 10. The photoelectric cell illustrated at 23 in FIG. 1 is positioned below the surface of the work table and is not illustrated in FIG. 2. A source of light 43 is positioned above the work table and angled so that it is located out of the area where the hands of the worker normally move, and slot 47 is formed in the work table along the path of the overhanging edges 18 of the pattern parts. The photoelectric cell detects the movement of the overlying edges 18 of the pattern parts as they move into the belts.

At the second work station the accumulation of the connected series of shirt cuff pattern parts 21 is fed from reel 46 to cutter-indexer 50 on a demand basis. A pair of reel support bars 51 are attached to work table 52 to support reel 46, and the free end of the connected series of partially completed shift cuffs is paid out from reel 46 in an upward direction and across work table 52 along a predetermined path as set by guides 54. When the connected series of partially completed shirt cuffs moves across work table 52, the continuous web of lining material 10 is located below the series of shirt cuff panels 15. Separator plate 55 is attached to the surface of work table 52 along one of its edges 56, and its opposite edge 58 is supported in cantilever arrangement over the path 57 traveled by web 10. The edge 59 of separator plate 55 which is located adjacent the guides 54 is bent down slightly so as to make positive contact with the web 10 as the web moves beneath the separator plate. The leading ends of each of the shirt cuff pattern parts attached to web 10 are thus inclined to be flipped or plowed in an upward direction so that the shirt cuff panels travel over the upper surface of separator plate 55.

Clutch-brake motor 60 is located beneath work table 52 and functions to rotate drive roller 61. Drive roller 61 is spring urged (not shown) in an upward direction against the bottom surface of separator plate 55, so that web 10, positioned in the path of the second work station below separator plate 55, is grasped between drive roller 61 and separator plate 55. When motor 60 functions to rotate drive roller 61 in the direction indicated by arrow 62, the web 10 is fed from reel 46 toward cutter 64.

Cutter 64 comprises a pair of stationary end supports 71 and 72, a pair of guide rods 74 and 75 connected at their ends to supports 71 and 72, movable cutter support 76, disc cutter 78, and pneumatic ram 79. Pneumatic ram 79 is supported by end support 72 and has its ramrod 80 connected to movable support 76. Ram 79 functions to oscillate movable support 76 back and forth along guide rods 74 and 75 as indicated by arrows 81. Disc cutter 78 is mounted on the bottom portion of movable support 76 and engages bearing plate 82. The photoelectric cell 30 which is positioned first along the path is located vertically above separator plate 55, and a source of light (not shown) is directed in a downward direction toward separator plate 55. Separator plate 55 is reflective, so that when a shirt cuff pattern part 15 moves across separator plate 55, the photoelectric cell 30 will detect no reflected light, and when a gap between adjacent ones of the shirt cuff pattern parts is detected by the photoelectric cell, the control circuitry of the system causes clutch brake motor 60 to terminate its rotation of drive roller 62, thus terminating the feeding movement of the connected series of partially completed shirt cuffs to cutter 64, and shifts a solenoid valve to actuate pneumatic ram 79 to move movable support 76 across the path of web 10. The disc cutter 78 walks or rolls on bearing plate 82 and cuts or crushes the material in its path. The disc cutter will cut straight across the web of material 10 at the trailing end of a pattern part. When the disc cutter reaches the opposite side of the path, its movement terminates and the control system is ready to recycle.

The photoelectric cell 29 which is positioned second along the path is located vertically above work table 52 on the other side of cutter 64 from the on-coming connected series of partially completed cuffs, and a source of light (not shown) is arranged to reflect from the surface of work table 52 into the photoelectric cell 29. When a partially completed cuff is present on work table 52 below photoelectric cell 29, no reflection is detected by the photoelectric cell. Photoelectric cell 29 is connected in the circuitry in a manner so as to prevent the control system from being reactivated when no reflected light is detected by the photoelectric cell, or when the leading partially completed cuff has been cut from its series and remains on the work table 52. When the worker at the second work station retrieves the separated partially completed cuff from the work table 52, photoelectric cell 29 will detect the light reflected from the work table 52 and will allow the cutter-indexer 50 to recycle.

FIG. 2A discloses the electrical circuitry which is included in the control system for operating the apparatus illustrated in FIG. 2. The photoelectric cell 23 (FIG. 1) operates switch **23*a* in a circuit made between conductors 86 and 87. Switch 23*a* is normally open when the photoelectric cell 23 detects light, and when the photoelectric cell detects darkness, as when the cell detects a pattern part moving through the system, switch 23*a* closes. When the pattern part moves beyond the cell and the cell detects light again, the switch 23*a* is maintained closed for a predetermined time delay. If the cell sees darkness again, or another on-coming pattern part, prior to the end of the time delay, the switch 23*a*** will remain closed.

The operator at the sewing and folding station illustrated in FIG. 2 manipulates a double throw foot switch 88 which is illustrated in its motor-off position. If the foot switch is "off", as when the operator is not attempting to cause the system to feed and sew, a circuit is made from conductor 86 through conductor 89, foot switch 88, relay 90, conductor 91, to conductor 87. This causes the contacts 92 and 93 of relay 90 to close and if the photoelectric cell 23 sees darkness as when detecting the presence of a pattern part in the proper position to be fed into the system, switch **23*a* will be closed and a relay holding circuit will be made from conductor 86, switch 23*a*, conductor 94, relay switch 92, conductor 95, relay 90, conductor 91 to conductor 87. Thus, when foot switch 88 is subsequently depressed by the operator and moved to open the circuit made to relay 90 from conductor 89, relay 90 will remain closed because of the holding circuit. Therefore, when the foot switch is moved from its "open" or holding circuit position to its "closed" or sewing position to start the feeding and sewing process, a circuit is made from conductor 86 through conductor 89, foot switch 88, conductor 96, relay switch 93 through clutch solenoid 97, to conductor 87. Clutch solenoid causes the clutch brake motor of the sewing machine to operate the sewing machine and the conveyor belt drive system of FIG. 2. The system will continue to operate for as long as the foot switch 88 is depressed by the operator and the photoelectric cell 23 sees darkness because of the passage of the overlying edges 18 of the shirt cuff pattern parts over slot 47** and only short pulses of light between adjacent ones of the moving shirt cuff pattern parts.

If the operator should allow too much space to appear between adjacent ones of the shirt cuff pattern parts as they are placed on the web 10, the photoelectric cell 23 will time out and switch **23*a* will open. This opens the holding circuit through relay 90, causing relay 90 to open its switch 93 to clutch solenoid 97 and the operation of the sewing machine and belt drive system terminates. When the operator places another shirt cuff pattern part close to the previously fed shirt cuff pattern part so that its overhanging edge 18 blocks the passage of light from light source 43 to photoelectric cell 23, switch 23***a* will be closed again, and the operator must allow foot switch 88 to move up to re-energize relay 90. When the relay 90 closes its switch 92, the holding circuit will be reestablished, and the operator can again depress the foot pedal 88 to resume the feeding and sewing steps.

While it is desirable to have only small spaces between the adjacent ones of the shirt cuff pattern parts, it is also important to have some space between the adjacent pattern parts so that the photoelectric cell of the cutting system can detect the space between adjacent ones of the pattern parts and cause the cutter indexer to perform its functions. Thus, the photoelectric cell 23 located below the work table 31 in the vicinity of the slot 47 can also function to control switch 99 in series with switch 23*a*, or a separate cell can be utilized, if desired. The photoelectric cell that controls switch 99 closes the switch when it sees light, and when the switch detects darkness, it remains closed for a time interval. If the switch sees light again before it times out, it remains closed, but if the switch times out before it sees light again it opens. With this arrangement, when a shirt cuff pattern part 15 is placed in abutment or in overlying relationship with a preceding shirt cuff pattern part, the photoelectric cell will not detect light between the two moving shirt cuff pattern parts, and it will time out and open its switch 99. This opens the holding circuit to relay 90 and to relay switch 93 in the circuit of clutch solenoid 97 and terminates the feeding and sewing functions. The operator must then separate the adjacent shirt cuff pattern parts before the system can be reactivated.

Figure 3:
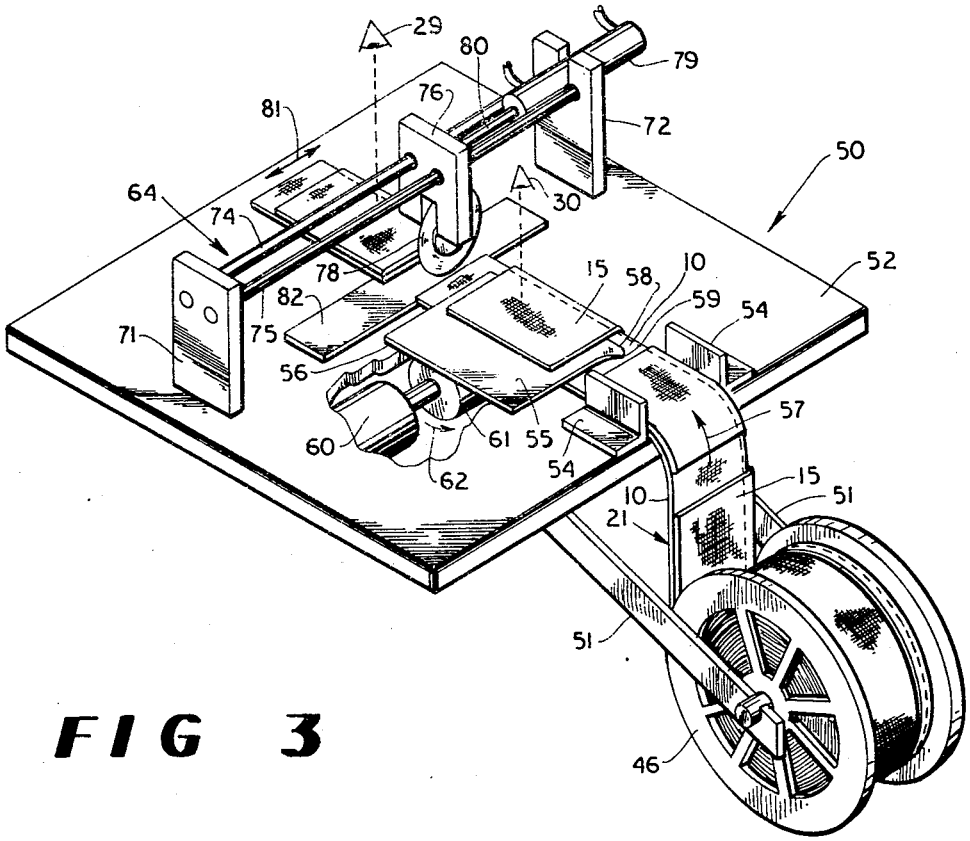
FIG. 3 is a schematic perspective illustration of the cutting apparatus.
Figure 3A:
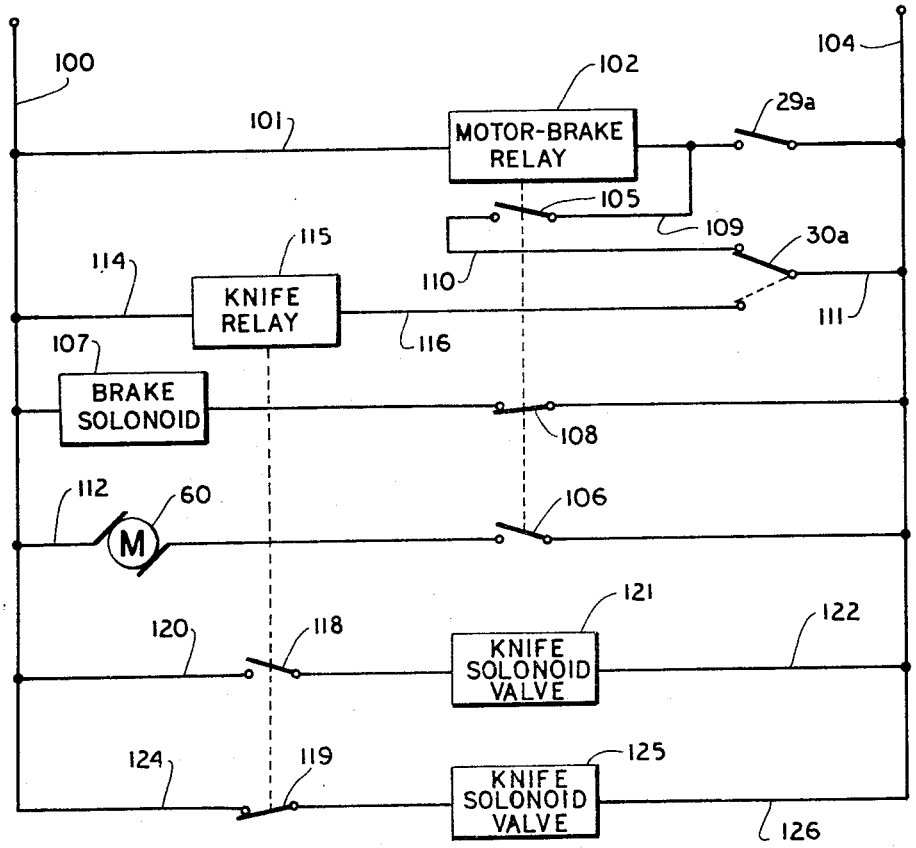
FIG. 3A is an electrical schematic of some of the control circuitry used in the operation of the apparatus illustrated in FIG. 3.

As is illustrated in FIG. 3A, the circuitry that is included in the control system for the cutter indexer 50 includes the switches 29*a* and 30*a* which are controlled by the photoelectric cells 29 and 30 (FIG. 3). Switch 29*a* is closed when it detects light and is open when it detects darkness. Thus, when photoelectric cell 29 detects the presence of a separated partially completed cuff awaiting the worker at the work table 52, switch 29*a* is open. When the worker retrieves the partially completed cuff for further processing, photoelectric cell 29 detects light and its contact 29*a* closes to make a circuit from conductor 100, through conductor 101, motor break relay 102, switch 29*a*, and conductor 104. Motor break relay 102 closes its normally open switches 105 and 106 and opens its normally closed switch 108. Switch 105 creates a holding circuit for the relay through conductors 109, 110, switch 30*a* of photoelectric cell 30, and conductor 111 to conductor 104. Thus, when photoelectric cell 29 detects darkness again by the oncoming partially completed cuff moving into the operator's ready station and its contact 29*a* opens, the holding circuit will continue to energize relay 102 and hold switches 105 and 106 closed and switch 108 open.

Switch 106 makes the circuit from conductor 100, conductor 112, and motor 60 to conductor 104. This causes the connected series of partially completed cuffs to feed from the reel 46 to the cutter indexer.

When photoelectric cell 30 detects the movement of a trailing end of a cuff panel across the reflector plate 55, it moves its switch 30*a* from the full line position to the dashed line position, thus breaking the holding circuit to motor break relay 102 and establishing a circuit from conductor 100 through conductor 114, knife relay 115, conductor 116, conductor 111, to conductor 104. The opening of the holding circuit to motor break relay 102 causes switches 105 and 106 to open and switch 108 to close, which causes the motor 60 to terminate the feeding of the connected series of partially completed cuffs to the cutter indexer and energizes brake solenoid 107 to rapidly stop the feeding. The making of the circuit to the knife relay 115 by switch 30*a* causes its switches 118 and 119 to shift so that switch 118 which was previously open now becomes closed and switch 119 which was previously closed is opened. The closing of switch 118 makes the circuit from conductor 100 through conductor 120, knife solenoid valve 121, conductor 122, back to conductor 104. The knife solenoid valve thus shifts so as to cause air to be in communication with one end of ram 79, causing the ram to distend and move the cutter 78 of cutter indexer. Knife relay 115 is a two position latch relay and its switches 118 and 119 remain in this condition until switch 30*a* is opened and then closed again. When switch 30*a* has been opened and closed again, knife relay 115 will shift to its opposite position, where its switches 118 and 119 will be reversed, with switch 118 moving back to its opened position and switch 119 moving back to its closed position. This opens the circuit to knife solenoid valve 121 and makes the circuit from conductor 100 through conductor 124, switch 119, the other knife solenoid valve 125, conductor 126, back to conductor 104. Knife solenoid valve 125 shifts to cause air under pressure to communicate with the opposite end of ram 79, causing the ramrod to retract and move the cutter 78 back in the opposite direction across a web of material.

When the operator removes the separated partially completed cuff from the work table 52, photoelectric cell 29 closes its contact 29*a*, causing motor break relay 102 to shift its switches 105 and 106 to their closed positions, and shifting its switch 108 to its open position, causing the motor 60 to feed the series of partially completed cuffs to the cutter indexer. When the photoelectric cell 30 detects the movement of the trailing end of a cuff panel moving across the detector plate 55, its switch 30*a* is shifted from its full line position to its dashed line position, thus breaking the circuit to the motor break relay and stopping the feeding movement, and energizing the knife relay 115. The knife relay 115 causes one of the knife solenoid valves 121 or 125 to pressurize the end of ram 79, to cause the cutter 78 to move in one direction only across the web of material, thus cutting the web of material. Although the photoelectric cell 29 may detect the oncoming cuff panel so as to open its switch 29*a*, the system will remain in operation because of the holding circuit made through the switch 30*a* of photoelectric cell 30 until the photoelectric cell 30 detects the proper location to make a cut, whereupon movement terminates and cutting begins.

From the foregoing description, it will be understood that the cutter indexer functions only on a demand basis, when the cut-away or separated partially completed cuff has been removed from the vicinity of the cutter. The cycle time of the cutter-indexer has been arranged to supply a separated partially completed cuff to the worker at a rate faster than the rate of operation of the subsequent trimming and sewing machine. Thus, the worker will always have a single partially completed cuff waiting to be retrieved for subsequent processing.

The photo cell 23 has been disclosed as initiating a response to the detection of the space between adjacent ones of the panels, to determine if the space is too long or too short, and the response disclosed is the step of terminating the process of feeding, folding and sewing. The response to the detection of gaps beyond the desired range also can be initiating an alarm or signal, such as a sound or a sight alarm, a counter, or possibly some other response. Also, several responses can be initiated simultaneously if desired, to train the operator and to keep records of the efficiency of the operator.

Although the cuff panels have been described as being sewn to the lining material, it will be understood by those skilled in the art that the descriptive phrases such as "sewing machine" and "sewing through the folds" are intended to include other types of attachment machines, such as fusing or adhesive machines which would function to connect the parts together as described, and the processes performed by the machines. Moreover, this invention has been described in detail, with particular reference to preferred embodiments thereof, and it will be understood that variations and modifications can be effected within the spirit and scope of the invention as described hereinbefore and as defined in the appended claims.

We claim:

1. A process of forming shirt cuffs or the like comprising moving a continuous web of lining material or the like along a path through a sewing machine at a first work station, placing panels of cuff material on the web of lining material spaced along the length of the web of lining material with an edge portion of the panels of cuff material overlying an edge of the lining material before the web of lining material is moved through the sewing machine and moving the panels of cuff material with the continuous web of lining material toward the sewing machine, detecting the space between adjacent ones of the panels of cuff material on the web, terminating the movement of the panels of cuff material and the continuous web of lining material toward the sewing machine when the spacing between adjacent ones of the panels of cuff material is not within a predetermined range of distances, folding the overlying edge portion of each of the panels of cuff material about the edge of the web of lining material as the web of lining material and panels of cuff material move toward the sewing machine, sewing through the folds of the panels of cuff material and the web of lining material to form a connected series of partially completed cuff assemblies, accumulating a supply of the connected series of partially completed cuff assemblies from the sewing machine, transferring the accumulated supply of the connected series of partially completed cuff assemblies to a second work station, moving the connected series of partially completed cuff assemblies along its length from its accumulated supply to a fabric cutter, stopping the movement of the connected series of partially completed cuff assemblies in response to the movement of a leading panel of cuff material moving past a predetermined position and cutting the lining material behind the leading panel to separate the leading partially completed cuff assembly from the rest of the series of partially completed cuff assemblies, removing the separated partially completed cuff assembly from the series of partially completed cuff assemblies, and beginning the movement of the rest of the connected series of cuff assemblies toward the fabric cutter in response to the removal of the separated partially completed cuff assembly from the series of partially completed cuff assemblies.

2. The process of claim 1 and wherein the step of moving the connected series of partially completed cuff assemblies along its length from its accumulated supply to a fabric cutter comprises the steps of simultaneously moving the web of lining material beneath a reflective plate while moving the panels of cuff material over the reflective plate, and wherein the steps of stopping the movement of the connected series of partially completed cuff assemblies and cutting the lining material behind the leading panel comprise detecting the movement of an edge portion of each panel of cuff material as it moves over the reflective plate, terminating the movement of the series of partially completed cuff assemblies in response to the detection of an edge portion of a panel of cuff material and cutting the lining material between the panels of cuff material.

3. The process of claim 1 and wherein the step of cutting the lining material comprises the cycle of rolling a disc cutter against a bearing plate from one side of the path of the series of partially completed cuff assemblies in a first direction across the path to the other side of the path.

4. The process of claim 1 and wherein the step of moving the panels of cuff material with the continuous web of lining material toward the sewing machine comprises engaging the upper surfaces of the panels of cuff material and the web of lining material with the lower flight of a continuous conveyor belt and moving the lower flight of the continuous conveyor belt toward the sewing machine.

5. The process of claim 1 and wherein the step of terminating the movement of the panels of cuff material with the continuous web of lining material toward the sewing machine comprises terminating the movement in response to detecting a space between adjacent ones of the panels which is more than a predetermined distance.

6. The process of claim 1 and wherein the step of terminating the movement of the panels of cuff material with the continuous web of lining material toward the sewing machine comprises terminating the movement in response to detecting a space between adjacent ones of the panels which is less than a predetermined distance.

7. A process of forming shirt cuffs or the like comprising the steps of moving a web of cuff lining material or the like in a first direction along its length toward a sewing machine at a first work station, placing cuff panel pattern parts on the web of cuff lining material as the web of lining material moves toward the sewing machine with one edge portion of each of the cuff panel pattern parts overlying the web of lining material and with the cuff panel pattern parts being spaced from one another along the length of the web of cuff lining material within a predetermined distance, folding the overlying edge portion of each of the cuff panel pattern parts about an edge of the web of the cuff lining material as the web of lining material moves toward the sewing machine, sewing through the web of cuff lining material and the folded portion of the cuff panel pattern parts to form a connected series of partially completed shirt cuffs, accumulating the series of partially completed shirt cuffs moved through the sewing machine on a reel, transferring the reel to a second work station, moving the series of partially completed shirt cuffs from its reel toward a cutting station, stopping the movement of the series of partially completed shirt cuffs and severing the web of cuff lining material between the leading cuff panel pattern part and the next adjacent cuff panel pattern part to separate the leading partially completed shirt cuff from the series of partially completed shirt cuffs, removing the severed partially completed shirt cuff from adjacent the series of partially completed shirt cuffs, and beginning the movement of the series of the partially completed shirt cuffs in response to the removal of the severed partially completed shirt cuff from adjacent the series of partially completed shirt cuffs.

8. The process of claim 7 and wherein the step of severing the web of lining material between the precut pattern parts of cuff panel material comprises moving the web of cuff lining material on one side of a reflective surface and moving the cuff panel pattern parts on the opposite side of the reflective surface as the partially completed shirt cuffs move toward the cutting station, detecting the movement of a cuff panel pattern part across the reflective surface, and cutting the web of lining material in response to the detection.

9. A process of forming shirt cuffs or the like comprising moving a continuous web along a path through a sewing machine, placing panels of cuff material on the web at spaced intervals along the length of the web with an edge portion of each of the panels of cuff material overlying an edge of the web before the web is moved through the sewing machine and moving the panels of cuff material with the web toward the sewing machine, detecting the space between adjacent ones of the panels of cuff material on the web, initiating a response to the detection of the space between adjacent ones of the panels being beyond a predetermined range of distances, folding the overlying edge portion of each of the panels of cuff material about the edge of the web as the web and the panels of cuff material approach the sewing machine, and sewing through the folds of the panels of cuff material and the web to form a connected series of partially completed cuff assemblies.

10. The process of claim 9 and wherein the step of initiating a response to the detection of the space between adjacent ones of the panels being beyond a predetermined range of distances comprises terminating the process.

11. The process of claim 9 and wherein the step of initiating a response to the detection of the space between adjacent ones of th panels being beyond a predetermined range of distances comprises terminating the process when the space between adjacent ones of the panels is more than a predetermined distance.

12. The process of claim 9 and wherein the step of initiating a response to the detection of the space between adjacent ones of the panels being beyond a predetermined range of distances comprises terminating the process when no space is detected.

13. The process of claim 9 and wherein the step of initiating a response to the detection of the space between adjacent ones of the panels being beyond a predetermined range of distances comprises energizing an alarm means.

14. A plurality of partially completed shirt cuff assemblies comprising an elongated web of cuff lining material and a plurality of cuff panels folded about and attached to one edge of the lining material manufactured by the process of moving an elongated web of lining material along a path through a sewing machine, placing panels of cuff material on the web at spaced intervals along the length of the web with an edge portion of each of the panels of cuff material overlying an edge of the web before the web is moved through the sewing machine and moving the panels of cuff material with the web toward the sewing machine, detecting the space between adjacent ones of the panels of cuff material on the web, folding the overlying edge portion of each of the panels of cuff material about the edge of the web as the web and the panels of cuff material approach the sewing machine, sewing through the folds of the panels of cuff material and the web and terminating the step of moving, folding and sewing in response to the detection of the space between adjacent ones of the panels being beyond a predetermined range of distances.

* * * * *